US011088488B2

(12) United States Patent
Yasuda et al.

(10) Patent No.: US 11,088,488 B2
(45) Date of Patent: Aug. 10, 2021

(54) CONNECTOR WITH ONE-SIDED DOVETAIL PROJECTIONS

(71) Applicant: Sumitomo Wiring Systems, Ltd., Mie (JP)

(72) Inventors: Tomoaki Yasuda, Mie (JP); Kazoaki Takeda, Mie (JP)

(73) Assignee: Sumitomo Wiring Systems, Ltd.

( * ) Notice: Subject to any disclaimer, the term of this patent is extended or adjusted under 35 U.S.C. 154(b) by 33 days.

(21) Appl. No.: 16/628,699

(22) PCT Filed: Jul. 10, 2018

(86) PCT No.: PCT/JP2018/025945

§ 371 (c)(1),
(2) Date: Jan. 6, 2020

(87) PCT Pub. No.: WO2019/026562

PCT Pub. Date: Feb. 7, 2019

(65) Prior Publication Data

US 2020/0169027 A1 May 28, 2020

(30) Foreign Application Priority Data

Jul. 31, 2017 (JP) ..... JP2017-147549

(51) Int. Cl.
*H01R 13/64* (2006.01)
*H01R 13/502* (2006.01)
*H01R 13/629* (2006.01)

(52) U.S. Cl.
CPC ..... *H01R 13/502* (2013.01); *H01R 13/64* (2013.01); *H01R 13/62933* (2013.01)

(58) Field of Classification Search
CPC ..... H01R 13/64; H01R 13/631; H01R 13/62938; H01R 13/62933; H01R 13/502;
(Continued)

(56) References Cited

U.S. PATENT DOCUMENTS 6,623,285 B2 * 9/2003 Nishide ..... H01R 13/62933 439/140
6,851,987 B2 * 2/2005 Mase ..... H01R 13/506 439/752

(Continued)

FOREIGN PATENT DOCUMENTS

JP 2004-103449 4/2004
JP 2004-178973 6/2004

(Continued)

OTHER PUBLICATIONS

International Search Report dated Sep. 18, 2018.

*Primary Examiner* — Edwin A. Leon
*Assistant Examiner* — Milagros Jeancharles
(74) *Attorney, Agent, or Firm* — Gerald E. Hespos; Michael J. Porco; Matthew T. Hespos

(57) ABSTRACT

A moving plate (12) for protecting tips of male tabs (15) is mounted into a receptacle (18). The moving plate (12) includes a peripheral wall (36) in the form of a rectangular frame, and the peripheral wall (36) includes long sides (43) and short sides (44). Projections (50) are provided on both sides across a center in a longitudinal direction on an outer surface of each long side (43). Recesses (31) shaped to correspond to the respective projections (50) and to be fit to the projections (50) are provided at positions corresponding to the projections (50) on an inner surface of the receptacle (18). Each of the projections (50) has a one-sided dovetail shape projecting toward a central side in the longitudinal direction, but not protruding toward an end side in the longitudinal direction.

7 Claims, 10 Drawing Sheets

(58) Field of Classification Search
CPC ..... H01R 13/514; H01R 13/4223; H01R 13/4538; H01R 13/46; H01R 13/629–645
See application file for complete search history.

(56) References Cited

U.S. PATENT DOCUMENTS

| | | | | |
|---|---|---|---|---|
| 7,588,446 | B2 * | 9/2009 | Kobayashi ..... | H01R 13/62933 439/135 |
| 8,147,261 | B2 * | 4/2012 | Horiuchi ..... | H01R 13/4538 439/157 |
| 10,038,279 | B2 * | 7/2018 | Suzuki ..... | H01R 13/4538 |
| 2003/0109167 | A1 * | 6/2003 | Maegawa ..... | H01R 13/62933 439/374 |
| 2004/0106330 | A1 | 6/2004 | Mase et al. | |
| 2006/0154505 | A1 * | 7/2006 | Nishide ..... | H01R 13/4538 439/157 |
| 2008/0207024 | A1 | 8/2008 | Kobayashi | |

FOREIGN PATENT DOCUMENTS

| | | |
|---|---|---|
| JP | 2008-210614 | 9/2008 |
| JP | 2011-124018 | 6/2011 |

* cited by examiner

CONNECTOR WITH ONE-SIDED DOVETAIL PROJECTIONS

BACKGROUND

Field of the Invention

The invention relates to a connector.

Related Art

Japanese Unexamined Patent Publication No. 2011-124018 discloses a male connector with a receptacle. Male tabs are arranged to project into the receptacle and a moving plate is mounted into the receptacle. The moving plate includes a plate body in the form of a flat plate, and the plate body is provided with insertion holes into which the male tabs are substantially positioned and inserted. The moving plate is movable from a connection initial position to a connection end position on a back side in the receptacle, and projecting amounts of the male tabs from the insertion holes are gradually increased toward the connection end position.

The moving plate includes a plate guide portion in the form of a rectangular tube that slides on the inner surface of the receptacle during a movement. Dovetail portions are provided at intervals in a circumferential direction on the outer surface of the plate guide portion and extend in a front-rear direction. Each dovetail portion has the same shape and has a reverse-tapered double-sided dovetail structure widening toward a tip surface in a projecting direction. Dovetail grooves are provided in the inner surface of the receptacle at positions corresponding to the respective dovetail portions.

The plate guide portion includes a pair of long sides facing each other in a lateral direction and a pair of short sides facing each other in a vertical direction. The respective dovetail portions are provided on the outer surface of each of the long and short sides.

Generally, the long sides and the short sides of this type are reduced in weight and formed thin as a whole to ensure the smoothness of the movement of the moving plate. On the other hand, if the long sides are thinned, longitudinal central sides of the long sides may contract to curve and deform in a cooling process during molding. However, according to the above configuration, the respective dovetail portions on the long sides are fit into the corresponding dovetail grooves so that the curved and deformed state of the longitudinal central sides of the long side portions can be corrected.

In the above case, the dovetail portion has the double-sided dovetail structure. Thus, a contact area of the dovetail portion and the dovetail groove is larger than a normal convex-concave mating structure and a contact area of the plate guide portion and the receptacle increases. As a result, the moving plate may not be able to move smoothly in the receptacle. In contrast, if the dovetail mating structure of the dovetail portions and the dovetail grooves is changed to a normal convex-concave mating structure, the contact area of the plate guide portion and the receptacle can be reduced, but it becomes difficult to correct the deformed state of the long side portions.

The invention was completed on the basis of the above situation and aims to provide a connector capable of correcting a deformed state of long sides and enabling a moving plate to move smoothly in a receptacle.

SUMMARY

The invention is directed to a connector with a receptacle, a male tab being arranged to project into the receptacle, and a moving plate including an insertion hole. The male tab being is positioned and insertable into the insertion hole. The moving plate moves backward in the receptacle to increase a projecting amount of the male tab from the insertion hole. The moving plate includes a peripheral wall in the form of a rectangular frame slidable on an inner surface of the receptacle and the peripheral wall has a long side portion and a short side portion. Projections are provided on both sides across a center in a longitudinal direction on an outer surface of the long side and recesses shaped to correspond to the projections and to be fit to the projections are provided at positions corresponding to the projections on the inner surface of the receptacle. Each of the projections has a one-sided dovetail shape protruding toward a central side in the longitudinal direction, but not protruding toward an end side in the longitudinal direction.

Each projection protrudes toward the central side in the longitudinal direction, but does not protrude toward the end side in the longitudinal direction. Thus, a state where a longitudinal central side of the long side portion is curved and deformed can be corrected effectively by fitting the respective projections into the corresponding recesses. Further, since the projection is formed into the one-sided dovetail shape, a contact area of the projection and the recess can be reduced and the moving plate can move smoothly in the receptacle as compared to the case where the projection is formed into a double-sided dovetail shape.

A mating female housing may be fittable into the receptacle. An erroneous connection preventing projection may be provided on an inner surface of the long side portion and may be configured to be fit into an erroneous connection preventing recess of the female housing. The long side portion may include a thick formed by the erroneous connection preventing projection and the projection overlapping each other in the longitudinal direction. According to this configuration, the strength of the long side portion can be enhanced and the long side portion can be prevented from being curved and deformed.

The projections may be arranged asymmetrically on the long side portions in the longitudinal direction. According to this configuration, a direction discrimination property can be given to the moving plate so that the moving plate cannot b mounted in a wrong posture into the receptacle.

DETAILED DESCRIPTION

Figure 1:
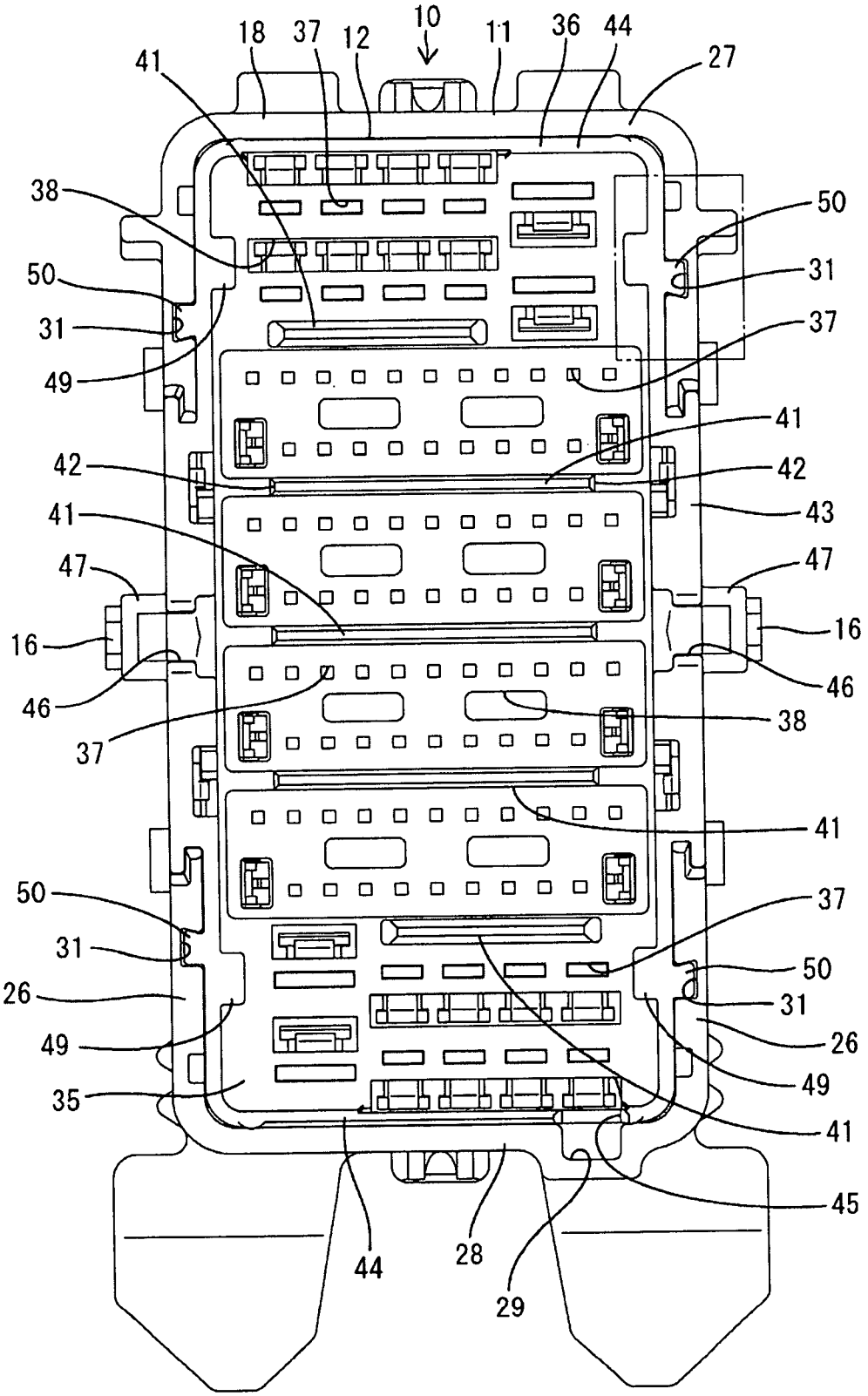
FIG. 1 is a front view of a male connector according to one embodiment of the present invention.

An embodiment of the invention is described on the basis of FIGS. 1 to 10. A connector of this embodiment is composed of a female connector 70 and a male connector 10 connectable to each other. The female connector 70 includes a female housing 71 and female terminal fittings 72. The male connector 10 includes a male housing 11, a moving plate 12, a lever 13 and male terminal fittings 14. Note that, in the following description, surfaces of the connectors 10, 70 facing each other at the start of connection are referred to as front ends concerning a front-rear direction and a vertical direction is based on figures except FIGS. 5 and 10.

Figure 7:
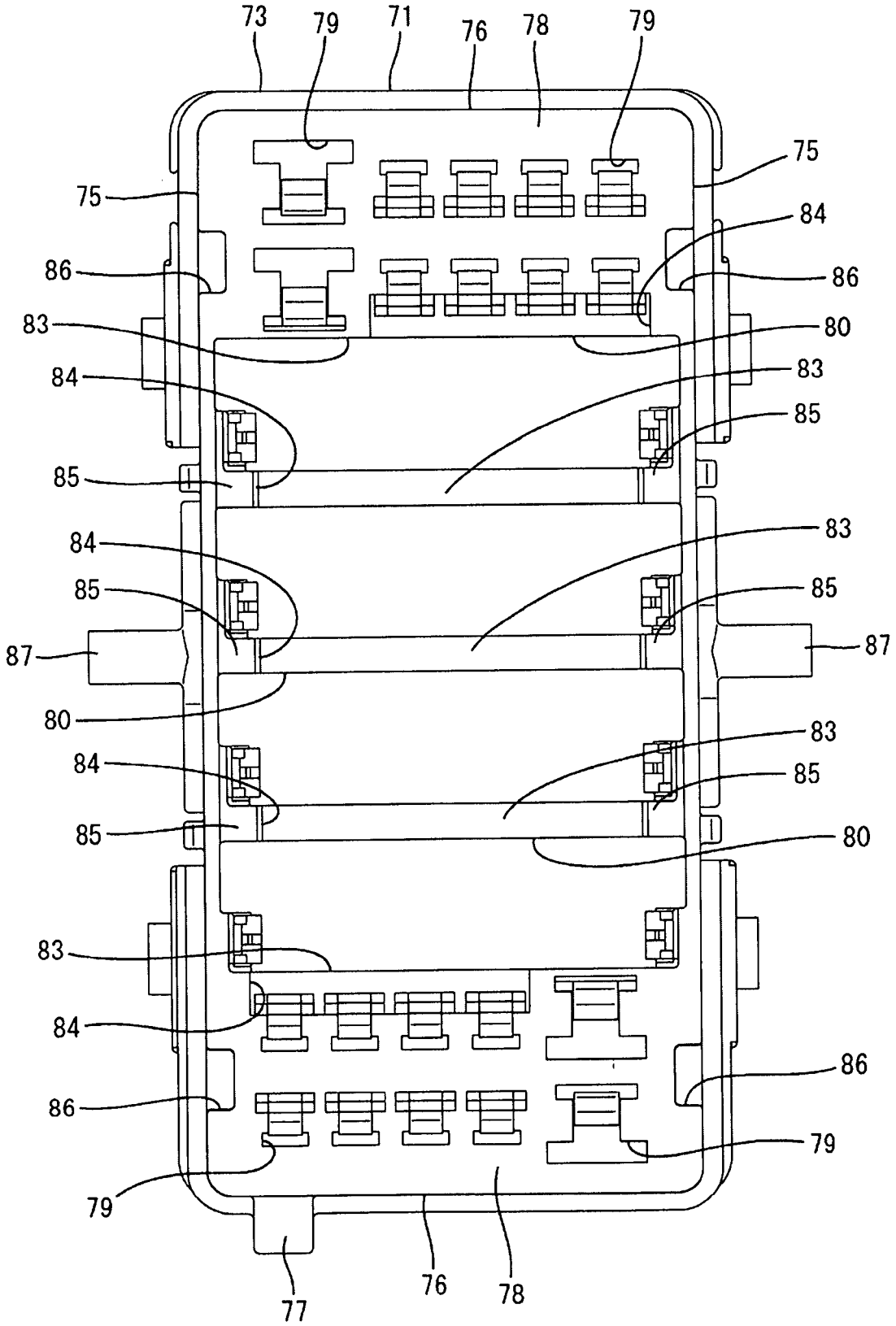
FIG. 7 is a front view of a female housing.
Figure 9:
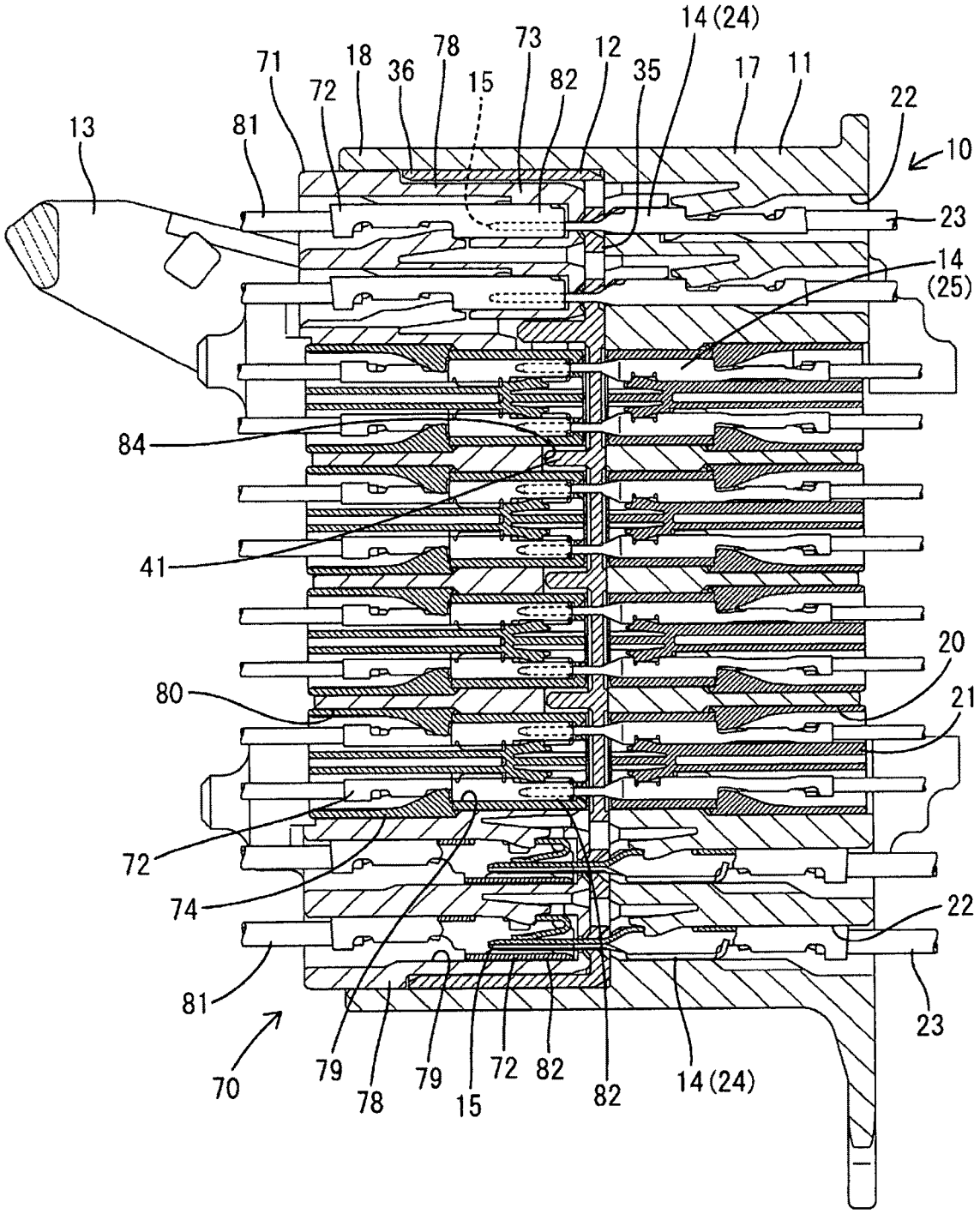
FIG. 9 is a section showing a state where both connectors are properly connected.

The female housing 71 is made of synthetic resin and includes, as shown in FIG. 9, a frame 73 and female sub-housings 74. As shown in FIG. 7, the frame 73 is in the form of a rectangular tube long in the vertical direction and include left and right long side walls 75 arranged along the vertical direction and upper and lower short side walls 76 arranged along a lateral direction. A rib 77 projects on one left or right side of the lower surface of the lower short side wall 76. The rib 77 extends in the front-rear direction and has a substantially rectangular cross-section.

Two block-like female terminal accommodating portions 78 are provided in both upper and lower end parts of the frame 73. The female terminal accommodating portions 78 are integrated with the long side walls 75 and the short side walls 76 and include female cavities 79 inside. Further, female sub-housing accommodation chambers 80 are provided inside the frame 73. The respective female sub-housing accommodation chambers 80 are shaped to have a substantially rectangular opening long in the lateral direction and are arranged side by side in the vertical direction between the female terminal accommodating portions 78.

As shown in FIG. 9, the female sub-housing 74 is inserted and accommodated into each female sub-housing accommodation chamber 80 from behind. Each female sub-housing 74 is provided with female cavities 79 similarly to the female terminal accommodating portion 78. The female terminal fitting 72 is inserted and accommodated from behind into each female cavity 79 in each of the female sub-housings 74 and the female terminal accommodating portions 78. Each female terminal fitting 72 has a rear part connected to an end part of a wire 81 and includes, on a front part, a box-like (tubular) connecting portion 82 for receiving a male tab 15 of the mating male terminal fitting 14 for connection.

As shown in FIG. 7, separation walls 83 spaced apart in the vertical direction are provided to partition between the respective female sub-housing accommodation chambers 80 and between the female sub-housing accommodation chamber 80 and the female terminal accommodating portion 78. Each separation wall 83 extends in the lateral direction and has both left and right ends integrally coupled to the long side walls 75. The separation wall 83 between the respective female sub-housing accommodation chambers 80 is in the form of a flat plate along the lateral direction.

The front end of each separation wall 83 is cut into a recess 84 having a substantially rectangular cross-section. The recesses 84 in the separation walls 83 between the respective female sub-housing accommodation chambers 80 are shallower in the front-rear direction than the recesses 84 in the separation walls 83 between the female sub-housing accommodation chamber 80 and the female terminal accommodating portion 78. Further, two end walls 85 are provided on both left and right sides of the recess 84 on each separation wall 83. Each of the end walls 85 has a substantially rectangular cross-section, a laterally inner end thereof defines the recess 84 and a laterally outer end thereof is coupled integrally to the long side wall 75 of the frame 73.

A plurality of erroneous connection preventing recesses 86 are provided in the outer surfaces of the long side walls 75 while being spaced apart in the vertical direction. Each erroneous connection preventing recess 86 is in the form of a groove extending in the front-rear direction, open in the front end of the long side wall 75 and having a substantially rectangular cross-section. Two erroneous connection preventing recesses 86 are arranged in both upper and lower end parts of each long side wall 75.

A pair of cam followers 87 project in substantially vertically central parts of the outer surfaces of the long side walls 75. The cam followers 87 are in the form of flat columns long in the front-rear direction.

Figure 3:
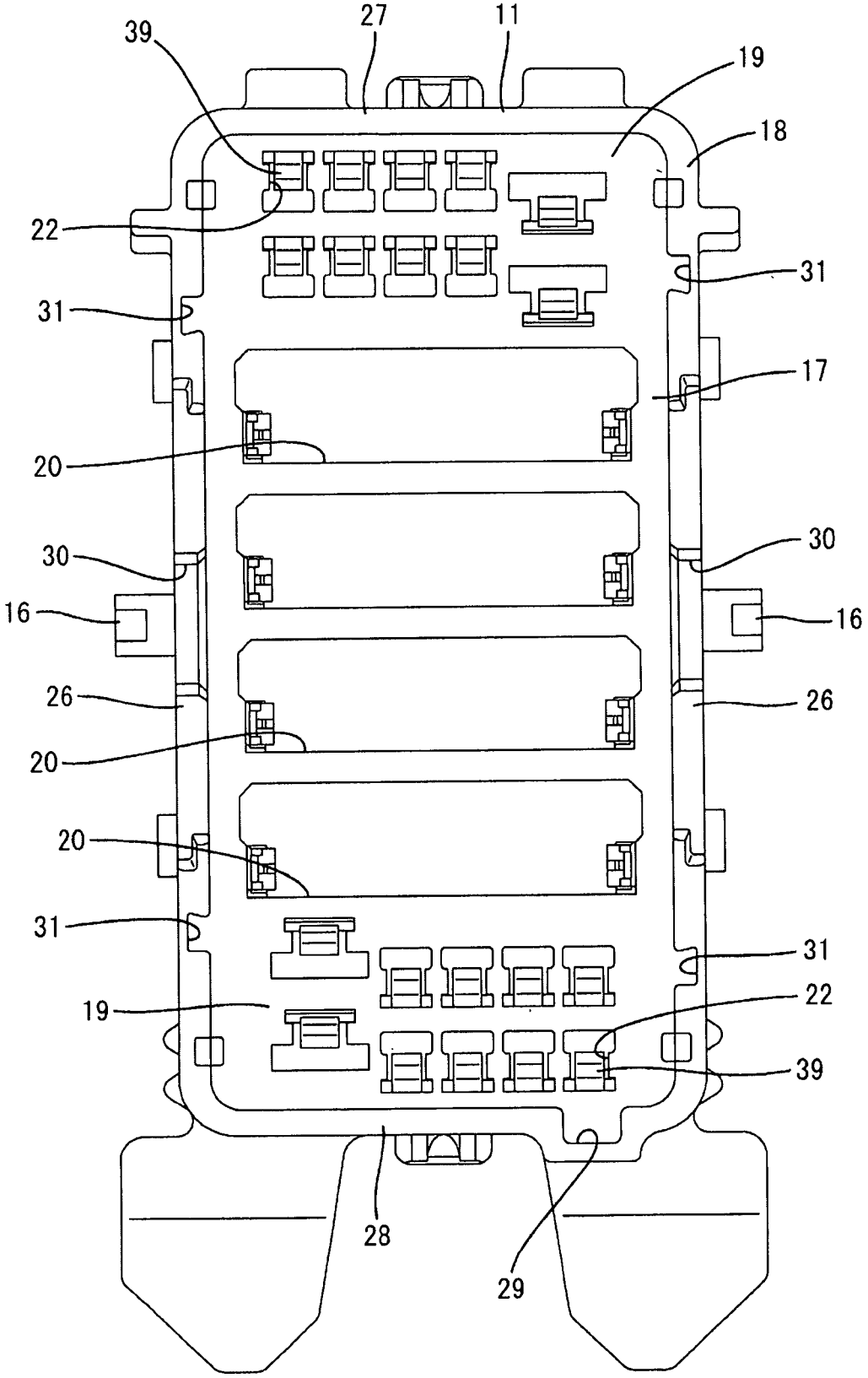
FIG. 3 is a front view of a male housing.

The female housing 11 is made of synthetic resin and, as shown in FIG. 3, vertically long. Two support shafts 16 project in substantially vertically central parts of both outer side surfaces of the male housing 11, and the lever 13 is supported rotatably on the support shafts 16. The lever 13 is made of synthetic resin, is U-shaped although not shown in detail, and is mounted over the male housing 11. Connection of the housings 11, 71 proceeds by rotating the lever 13 from an initial position toward a connection position about the support shafts 16 with the lever 13 engaged with the mating female housing 71.

Figure 8:
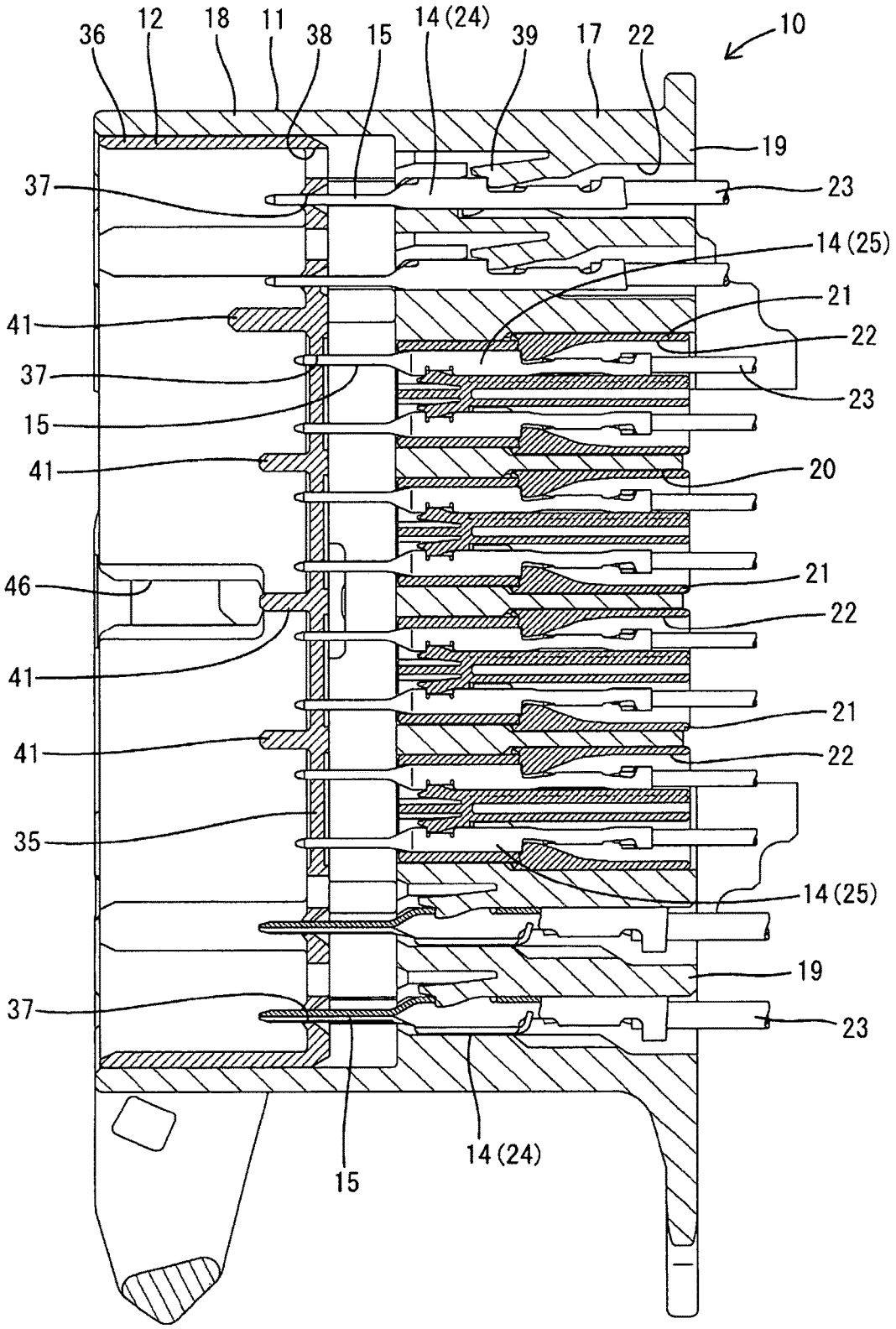
FIG. 8 is a section showing a state where the moving plate is held at an initial position with respect to the male housing in the male connector.

The male housing 11 includes a male body 17 similar in shape to the female housing 71 and a receptacle 18 projects forward from the outer edge of the male body 17. The male body 17 includes both male terminal accommodating portions 19 and male sub-housing accommodation chambers 20 similar to the female terminal accommodating portions 78 and the female sub-housing accommodation chambers 80 at positions corresponding to these female terminal accommodating portions 78 and female sub-housing accommodation chambers 80. The male sub-housing 21 is inserted and accommodated into each male sub-housing accommodation chamber 20 from behind. As shown in FIG. 8, the male terminal fitting 14 is inserted and accommodated into each male cavity 22 provided in each of the male terminal accommodating portions 19 and the male sub-housings 21.

Each male terminal fitting 14 includes a tubular body to be locked to an inner wall of each male cavity 22, a part to be connected to an end part of a wire 23 is connected behind the body, and the male tab 15 projects forward from the body. The male tab 15 of each male terminal fitting 14 is arranged to project into the receptacle 18. The respective male terminal fittings 14 to be accommodated into the male terminal accommodating portions 19 are relatively large large-size male terminals 24, and the respective male terminal fittings 14 to be accommodated into the respective male sub-housings 21 are relatively small small-size male terminals 25. The male tabs 15 of the large-size male terminals 24 project farther into the receptacle 18 than the male tabs 15 of the short-size male terminals 25.

As shown in FIG. 3, the receptacle 18 is in the form of a rectangular tube long in the vertical direction and includes left and right side walls 26 along the vertical direction and an upper and lower walls 27 and 28 along the lateral direction. A rib receiving portion 29 is provided on one left or right side of the lower wall 28. The rib receiving portion 29 bulges to have a substantially rectangular cross-section, extends in the front-rear direction and is open in the front end of the receptacle 18. By fitting and inserting the rib 77 into the rib receiving portion 29, the female housing 71 is connected in a proper posture to the male housing 11.

Two entrance openings 30 are provided in substantially vertically central parts of the side walls 26. The entrance openings 30 are open in the front ends of the side walls 26 and can receive later-described cam portions inside.

Further, recesses 31 are provided in the inner surfaces of the side walls 26. The recesses 31 are arranged in each of the side walls 26 while being spaced apart in the vertical direction. Two of the recesses 31 are arranged on both sides across a vertical center (longitudinal center) where the entrance opening 30 is provided. More particularly, the recesses 31 provided in one side wall 26 (right side wall 26 of FIG. 3) are arranged at positions near vertically outer end parts, and the recesses 31 provided in the other side wall 26 (left side wall 26 of FIG. 3) are arranged at positions somewhat distant from the vertically outer end parts. Thus, the respective recesses 31 are laterally asymmetrically arranged on the side walls 26. In this embodiment, the upper and lower recesses 31 are arranged at positions equidistant from the vertical center of the side wall 26. Of course, the upper and lower recesses 31 may be arranged at positions differently distant from the vertical center of the side wall 26.

Figure 2:
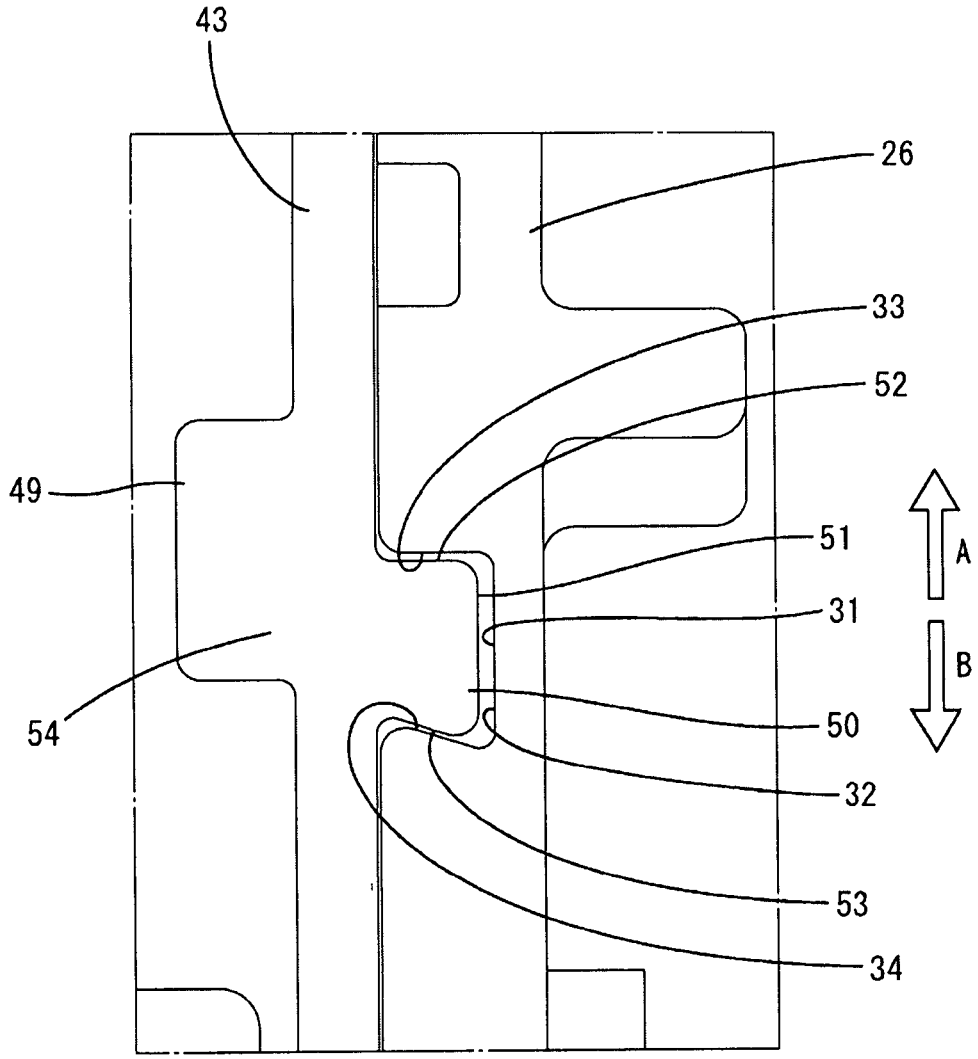
FIG. 2 is a partial enlarged view of FIG. 1.

Each recess 31 is formed into a one-sided dovetail shape. Particularly, each recess 31 is defined by a back surface 32 (bottom surface) along the vertical direction, a horizontal surface 33, which is an end surface (end surface on a side distant from the vertical center of the side wall 26) on a vertically outer side (direction of an arrow A in FIG. 2) and extends along the lateral direction perpendicular to the back surface 32, and an inclined surface 34, which is an end surface (end surface on a side near the vertical center of the side wall 26) on a vertically inner side (direction of an arrow B in FIG. 2) of the side wall 26 and arranged at an acute angle to the back surface 32, as shown in FIG. 2. In other words, the inclined surface 34 is linearly inclined toward the vertically central side from an inner surface side of the side wall 26 toward the back surface 32.

Figure 4:
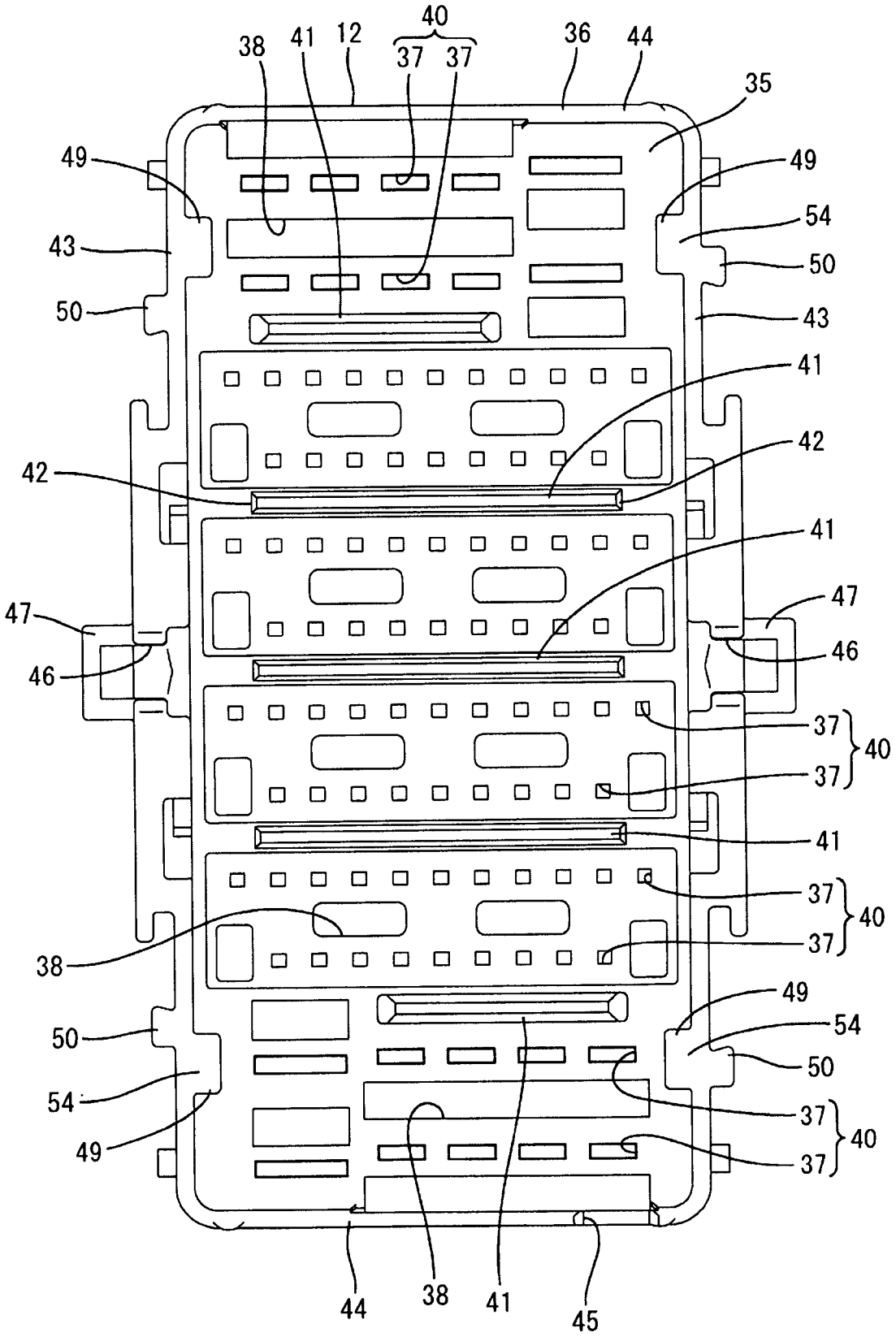
FIG. 4 is a front view of a moving plate.
Figure 6:
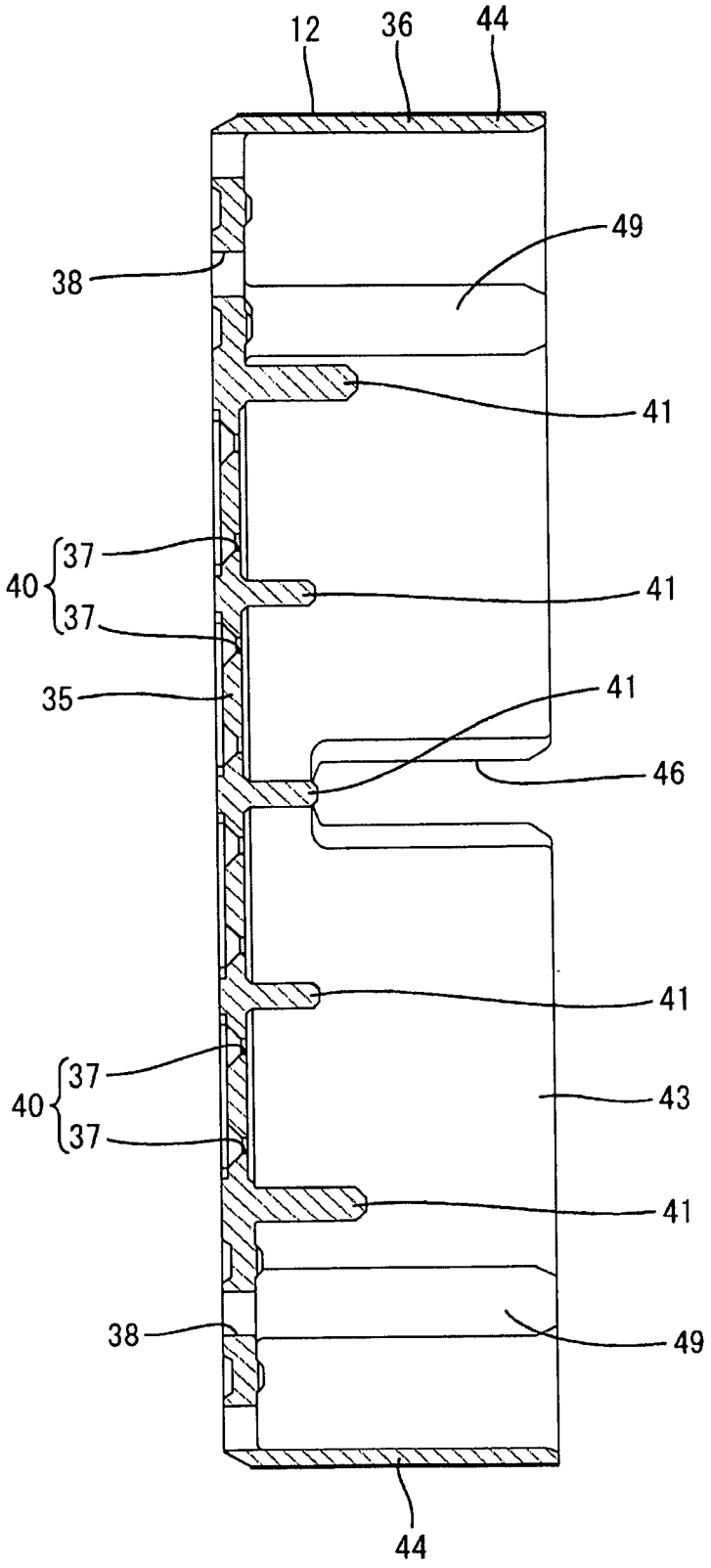
FIG. 6 is a section of the moving plate.

Next, the moving plate 12 is described. The moving plate 12 is made of synthetic resin and includes, as shown in FIGS. 4 and 6, a plate body 35 substantially in the form of a rectangular flat plate along the vertical direction and a peripheral wall 36 substantially in the form of a rectangular tube projecting forward from the outer peripheral edge of the plate body 35.

Insertion holes 37 penetrate through the plate body 35. Each insertion hole 37 is an opening having a substantially rectangular cross-section, and the male tab 15 of the male terminal fitting 14 can be inserted in a positioned state inside. The insertion holes 37 corresponding to the respective large-size male terminals 24 are open a large amount in the lateral direction so that the wide male tabs 15 can be positioned and inserted. Further, tool insertion holes 38 penetrate through the plate body 35 at positions vertically adjacent to the respective insertion holes 37. As shown in FIG. 8, the tool insertion holes 38 are arranged at positions corresponding to locking lances 39 and an unillustrated tool is inserted therein. The locking lance 39 projects from the inner surface of the male cavity 22 and has a function of resiliently locking and retaining the male terminal fitting 14, and a state of locking the male terminal fitting 14 is released by the tool. As shown in FIG. 4, the respective tool insertion holes 38 that are adjacent to the large insertion holes 37 are open a large in a width direction.

The plate body 35 is provided with insertion hole groups 40 in the vertical direction when the respective insertion holes 37 in two upper and lower rows constitute one insertion hole group 40. The respective insertion hole groups 40 are at positions corresponding to the mating female sub-housings 74 and female terminal accommodating portions 78. Protection walls 41 project in such a manner as to partition between vertically adjacent ones of the insertion hole groups 40 on the front surface of the plate body 35. The respective protection walls 41 are in the form of ribs extending in the lateral direction and arranged parallel to each other at constant intervals in the vertical direction. Both left and right ends of each protection wall 41 are open ends 42 separated from later-described long side portions 43 of the peripheral wall 36 without being connected to the peripheral wall 36. The protection walls 41 adjacent to the large insertion holes 37 in upper and lower end parts project more and are thicker in the vertical direction than the other protection walls 41 (protection walls 41 adjacent to the small insertion holes 37).

The protection walls 41 are arranged at the same heights as separation walls 83 of the female housing 71 and are continuous with the respective separation walls 83 in the front-rear direction when the connectors 10, 70 are connected. A vertical thickness of each protection wall 41 is smaller than that of the corresponding separation wall 83.

Figure 5:
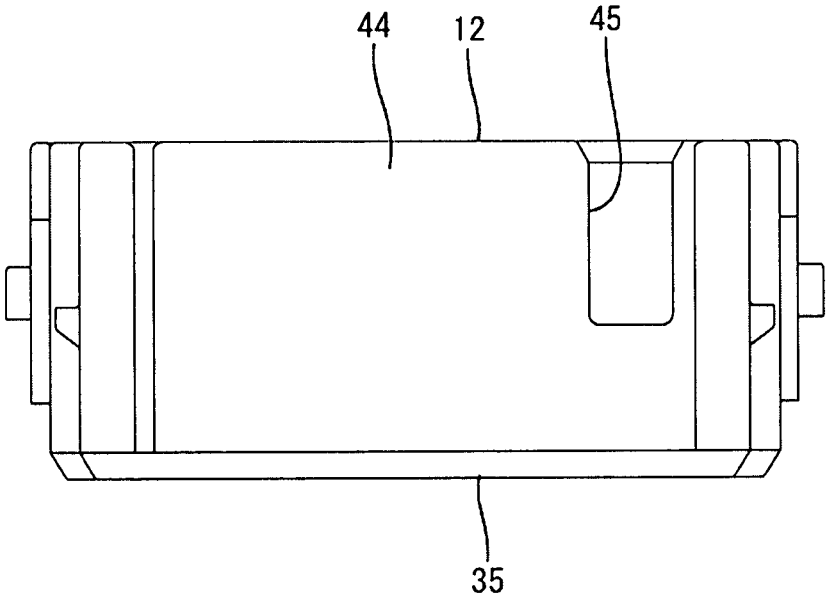
FIG. 5 is a bottom view of the moving plate.

The peripheral wall 36 includes left and right long sides 43 arranged along the vertical direction and upper and lower short sides 44 arranged along the lateral direction. A rib escaping portion 45 is provided on one left or right side of the lower short side 44. As shown in FIG. 5, the rib escaping portion 45 extends in the front-rear direction and is open in the front end of the short side 44. The rib 77 of the female housing 71 is fit and inserted into the rib receiving portion 29 of the receptacle 18 through the rib escaping portion 45.

Two introduction openings 46 are provided in substantially vertically central parts of the long sides 43 and communicate with the entrance openings 31 of the receptacle 18 at the time of assembling. As shown in FIG. 4, cam pins 47 project on the outer surfaces of the long sides 43 at positions corresponding to back ends of the introduction openings 46. In the process of connecting the housings 11, 71, the cam followers 87 of the female housing 71 enter the introduction openings 46 and are united with the cam pins 47 to constitute the cams, and these cams engage with the lever 13 via the entrance openings 30 of the receptacle 18 so that the moving plate 12 and the male housing 11 move according to the rotation of the lever 13.

Erroneous connection preventing projections 49 are provided on the inner surfaces of the long sides 43 and extend in the front-rear direction while being spaced apart in the vertical direction. As shown in FIGS. 4 and 6, each erroneous connection preventing projection 49 is in the form of a rib having a substantially rectangular cross-section and has a front end facing the front end of the long side 43 and a rear end connected to the plate body 35. Two of the erroneous connection preventing projections 49 are arranged on both upper and lower end parts of each long side 43. Each erroneous connection preventing projection 49 is fit and inserted into the corresponding erroneous connection preventing recess 86 of the female housing 71 when the housings 11, 71 are connected.

Further, projections 50 are provided on the outer surfaces of the long sides 43. The respective projections 50 are arranged on each of the long sides 43 while being spaced apart in the vertical direction. Particularly, two the projections 50 are arranged on both sides across a vertical center (longitudinal center) where the introduction opening 46 is provided. More particularly, the projections 50 provided on one long side 43 are arranged at positions near vertically outer end parts and the projections 50 on the other long side 43 are at positions somewhat distant from the vertically outer end parts. Thus, the respective projections 50 are laterally asymmetrical on the both long sides 43. In this embodiment, the upper and lower projections 50 are at positions equidistant from the vertical center of the long side portion 43. Of course, the upper and lower projections 50 may be at different distances from the vertical center of the long side 43.

Each projection 50 is formed into a one-sided dovetail shape. More particularly, each projection 50 is defined by a projecting end surface 51 (tip surface), a flat surface 52 and an overhanging surface 53. The projecting end surface 51 extends along the vertical direction. The flat surface 52 is an end surface on a side distant from the vertical center of the long side 43 and is on a vertically outer side (direction of the arrow A in FIG. 2). The flat surface 52 extends along the lateral direction perpendicular to the projecting end surface 51. The overhanging surface 53 is an end surface on a side near the vertical center of the long side 43 and hence is on a vertically inner side (direction of the arrow B in FIG. 2). The overhanging surface 53 is arranged at an acute angle to the projecting end surface 51, as shown in FIG. 2. In other words, the overhanging surface 53 is gradually inclined toward the vertically central side from an outer surface side of the long side 43 toward the projecting end surface 51.

As shown in FIG. 4, the long sides 43 are provided with thick portions 54 thickened by partial overlapping of the projections 50 and the respective erroneous connection preventing projections 49 in the vertical direction. The thick portions 54 are provided at positions corresponding to three sets of the projections 50 and the erroneous connection preventing projections 49 except the projection 50 and the erroneous connection preventing projection 49 on a left-upper side of FIG. 4.

Next, functions and effects of this embodiment are described.

Prior to the connection of the connectors 10, 70, the moving plate 12 is mounted into the receptacle 18 of the male housing 11. As shown in FIG. 8, the moving plate 12 is arranged at the initial position where the plate body 35 is separated forward from the front surface of the male body portion 17. At this time, the moving plate 12 is held in a movement restricted state at the initial position by being locked by a lock of the receptacle 18. Further, a tip of the male tab 15 of each male terminal fitting 14 is inserted in a substantially positioned state into the corresponding insertion hole 37 of the plate body 35.

When the moving plate 12 is at the initial position, the tips (front ends) of the respective male tabs 15 are retracted rearward from the tips (front ends) of the adjacent protection walls 41. Thus, even if the female connector 70 is inclined with respect to the receptacle 18 when the connectors 10, 70 are connected, the female connector 70 in such an erroneous connection posture comes into contact with the tips of the protection walls 41 without substantially interfering with the tips of the respective male tabs 15. Therefore the respective male tabs 15 are maintained in a protected state.

Further, when the moving plate 12 is at the initial position, the tips of the male tabs 15 pass through the corresponding insertion holes 37 and project forward of the plate body 35. Thus, when the moving plate 12 is at the initial position, a conduction test can be conducted by pressing an unillustrated probe pin for conduction test to projecting parts of the tip parts of the respective male tabs 15 from the front.

As shown in FIG. 1, the peripheral wall 36 is arranged to contact (slide in contact) with the inner surface of the receptacle 18 along the circumferential direction when the moving plate 12 is mounted into the receptacle 18. Particularly, the long sides 43 and the short sides 44 are respectively arranged to contact the side walls 26, the upper wall 27 and the lower wall 28, and the moving plate 12 is positioned without being inclined in the receptacle 18.

Further, the projections 50 of the long side portions 43 of the peripheral wall 36 are fit and inserted into the respective recesses 31 of the side walls 26 of the receptacle 18. Particularly, as shown in FIG. 2, the projecting end surface 51, the flat surface 52 and the overhanging surface 53 of the projection 50 are arranged to contact the back surface 32, the horizontal surface 33 and the inclined surface 34 of each recess 31.

The moving plate 12 is reduced in weight and entirely formed thin to ensure a smooth movement. Especially, since the peripheral wall 36 is in the form of a rectangular tube long in the vertical direction, the vertically central sides of the long sides 43 easily curve and deform inward toward each other in a cooling process during resin molding. However, in this embodiment, the moving plate 12 is mounted into the receptacle 18 and each projection 50 is fit and inserted into the corresponding recess 31. Thus, the overhanging surface 53 of each projection 50 contacts the inclined surface 34 of the corresponding recess 31 to bite into this inclined surface 34. Thus, a state where the vertically central parts of the long sides 43 are curved and deformed inwardly is corrected effectively.

Figure 10:
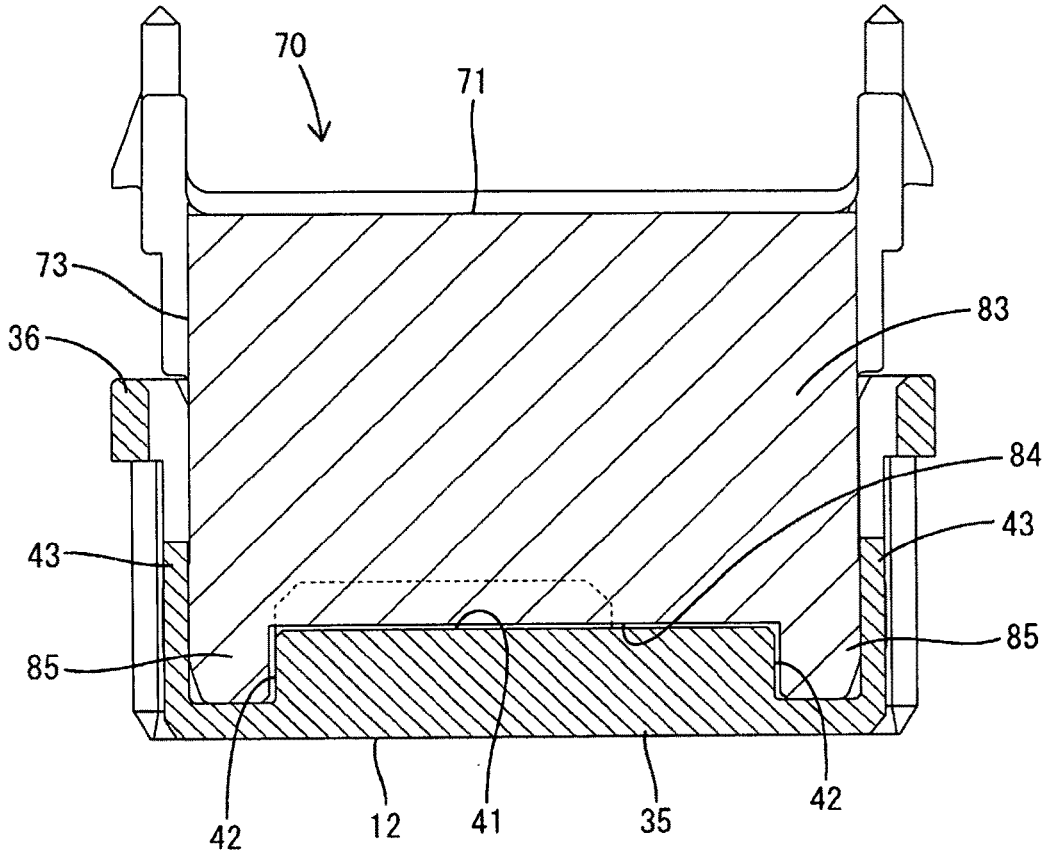
FIG. 10 is a section showing a state where a protection wall is inserted in a recess of a separation wall.

Subsequently, the connectors 10, 70 are connected by inserting the female housing 71 into the receptacle 18 of the male housing 11 while facing the plate body 35 of the moving plate 12. Then, as shown in FIG. 10, the substantially entire protection wall 41 is inserted into the corresponding recess 84 of each separation wall 83. The protection wall 41 is arranged so that a tiny clearance is defined between the protection wall 41 and the female sub-housing 74 or the female terminal accommodating portion 78 in the vertical direction (see FIG. 9), whereas the protection wall 41 is positioned by arranging the open ends 42 such that the open ends 42 can contact the end walls 85 in the lateral direction. The end walls 85 are positioned in the lateral direction between the open ends 42 of the protection wall 41 and the long sides 43.

Further, the respective erroneous connection preventing projections 49 are fit and inserted into the respective erroneous connection preventing recesses 86 and the rib 77 is fit and inserted into the rib receiving portion 29 via the rib escaping portion 45, thereby avoiding a situation where the female housing 71 is erroneously connected in a vertically inverted posture with respect to the male housing 11 and the moving plate 12.

A shallow insertion of the female housing 71 into the receptacle 18 causes the cam followers 87 to unite with the cam pins 47 via the introduction openings 46 and the entrance openings 30 to constitute the cams. Additionally, the locking for restricting a backward movement of the moving plate 12 is released to enable the moving plate 12 to move to the back.

Subsequently, the lever 13 is rotated so that a cam mechanism is exhibited between the cams and the lever 13, and the female housing 71 is fit deeply into a back in the receptacle 18 together with the moving plate 12. During this time, the peripheral wall 36 of the moving plate 12 slides on the inner surface of the receptacle 18 and the projections 50 slide on the inner surfaces of the respective recesses 31 to guide a movement of the moving plate 12. When the connectors 10, 70 are connected properly in this way, the plate body 35 is substantially in contact with the male body 17 and sandwiched between the male body 17 and the female housing 71. Additionally, the male tabs 15 of the male terminal fittings 14 are inserted into the connecting portions 82 of the respective female terminal fittings 72 to be connected electrically, as shown in FIG. 9.

As described above, the protection walls 41 project between the insertion hole groups 40 of the plate body 35 according to this embodiment. Thus, the projecting parts of the tips of the respective male tabs 15 are protected by the protection walls 41 when the moving plate 12 is at the initial position. As a result, the breakage or damage of the respective male tabs 15 due to interference with external matter can be prevented.

Further, the protection walls 41 enter the recesses 84 provided in the separation walls 83 of the female housing 71 to escape when the connectors 10, 70 are connected. In this case, the protection walls 41 are separated from the long sides 43 of the peripheral wall 36 and the end walls 85 to be coupled to the frame 73 are left on both sides of each recess 84. Thus, the recesses 84 for receiving the protection walls 41 are not open over the entire width of the frame 73 in the separation walls 83, and the strengths of the separation walls 83 and the frame 73 are not reduced more than necessary. Further, due to the presence of the end walls 85, an external matter is less likely to enter the recesses 84 and the electrical reliability of the male tabs 15 can be ensured.

Further, the male tabs 15 include the large-size male terminals 24 having a large tab width and the small-size male terminals 25 having a small tab width, and the protection walls 41 adjacent to the tips of the large-size male terminals 24 are thicker than those adjacent to the tip parts of the small-size male terminals 25. Thus, even if the insertion holes 37 corresponding to the large-size male terminals 24 have large opening dimensions, the strength of the plate body 35 can be ensured by the thick protection walls 41. Further, since the protection walls 41 adjacent to the tips of the small-size male terminals 25 are not thick, the plate body 35 does not become heavier than necessary and the smoothness of the movement of the moving plate 12 can be ensured.

Furthermore, the projections 50 are formed into the one-sided dovetail shape protruding toward the vertically central side of the long side 43 of the receptacle 18, but not protruding toward the vertical end side according to this embodiment. Thus, the state where the vertically central sides of the long sides 43 are curved and deformed inwardly can be corrected effectively by fitting the respective projections 50 into the corresponding recesses 31. Further, since the projection 50 is formed into the one-sided dovetail shape, a contact area of the projection 50 and the recess 31 can be reduced and the moving plate 12 can move smoothly in the receptacle 18 as compared to the case where the projection 50 has a double-sided dovetail shape.

Further, the erroneous connection preventing projections 49 to be fit into the erroneous connection preventing recesses 86 of the female housing 71 are provided on the inner surfaces of the long side portions 43 of the receptacle 18, and the long sides 43 include the thick portions 54 where the erroneous connection preventing projection 49 and the projection 50 overlap each other in the vertical direction. Thus, the strengths of the long sides 43 can be enhanced and the long sides 43 will not curve and deform.

Further, since the projections 50 are arranged vertically asymmetrically on the long sides 43, a direction discrimination property is given to the moving plate 12 and, in cooperation with the rib 77, the moving plate 12 cannot be mounted in an erroneous posture into the receptacle 18.

Other embodiments are briefly described below.

The horizontal surface of the recess and the flat surface of the projection may be slightly inclined with respect to the lateral direction within such a range that the one-sided dovetail shapes of the recess and the projection are maintained.

Three or more recesses and three or more projections may be respectively provided side by side in the vertical direction on the side wall portions and the long side portions.

Parts corresponding to the female sub-housing accommodation chambers may be all configured as female terminal accommodating portions and the separation walls may be arranged between adjacent ones of the female terminal accommodating portion. Conversely, parts corresponding to the female terminal accommodating portions may be all configured as female sub-housing accommodation chambers and the separation walls may be arranged between adjacent ones of the female sub-housing accommodation chambers.

The longitudinal direction (formation direction) of the long side portions may be set to be the lateral direction perpendicular to that of the embodiment.

LIST OF REFERENCE SIGNS

10 . . . male connector
11 . . . male housing
12 . . . moving plate
14 . . . male terminal fitting
15 . . . male tab
18 . . . receptacle
31 . . . recess
35 . . . plate body
36 . . . peripheral wall
37 . . . insertion hole
41 . . . protection wall
43 . . . long side
44 . . . short side
49 . . . erroneous connection preventing projection
50 . . . projection
54 . . . thick portion
70 . . . female connector
71 . . . female housing
73 . . . frame
83 . . . separation wall
84 . . . recess
85 . . . end wall
86 . . . erroneous connection preventing recess

The invention claimed is:

1. A connector, comprising:

a receptacle, a male tab being arranged to project into the receptacle; and a moving plate including an insertion hole, the male tab being substantially positioned and insertable into the insertion hole, the moving plate moving backward in the receptacle to increase a projecting amount of the male tab from the insertion hole, wherein:

the moving plate includes a peripheral wall in the form of a rectangular frame slidable on an inner surface of the receptacle and the peripheral wall has first and second long sides facing each another and extending in a longitudinal direction and first and second short sides extending between the first and second long sides, a pair of projections are provided on outer surfaces of each of the first and second long sides at positions spaced from each other across a center in the longitudinal direction, each of the pair of projections is formed into a one-sided dovetail shape protruding toward a central side in the longitudinal direction, but not protruding toward an end side in the longitudinal direction, and recesses shaped to correspond to the projections and to be fit to the projections are provided at positions corresponding to the projections on the inner surface of the receptacle.

2. The connector of claim 1, wherein a mating female housing is fittable into the receptacle, an erroneous connection preventing projection is provided on an inner surface of the long side and is to be fit into an erroneous connection preventing recess of the female housing, and the long side includes a thick portion formed by the erroneous connection preventing projection and the projection overlapping each other in the longitudinal direction.

3. The connector of claim 2, wherein the projections are arranged asymmetrically on two of the long sides in the longitudinal direction.

4. A connector, comprising:

a receptacle having a body and a peripheral wall projecting from outer edges of the body, the peripheral wall having an inner surface and comprising first and second long sides arranged parallel to each other and extending in a longitudinal direction, and a pair of recesses formed in the inner surface of each of the first and second long sides, the pair of recesses being spaced from each other across a center line of the receptacle extending in a direction normal to the longitudinal direction, each of the pair of recesses having a one-sided dovetail shape protruding toward the central line in the longitudinal direction;

a male tab arranged to project into the receptacle; and a moving plate arranged in the receptacle and including an insertion hole positioned to receive the male tab, the moving plate moving backward in the receptacle to increase a projecting amount of the male tab from the insertion hole, the moving plate having a peripheral wall with first and second long sides facing each other and extending in a longitudinal direction, each of the first and second long sides having an outer surface slidable on the inner surface of the receptacle, at least two projections formed on the outer surfaces of each of the first and second long sides at positions aligned with the pairs of recesses of the receptacle, each of the projections having a one-sided dovetail shape arranged so that projecting ends of each of the projections protrude towards each other.

5. The connector of claim 4, further comprising:

a mating female housing fittable into the receptacle, the female fitting having at least two erroneous connection preventing recesses formed on an outer surface thereof;

at least two erroneous connection preventing projections are provided on the inner surface of the peripheral wall of the moving plate and are fit into the erroneous connection preventing recesses when the female housing is fit into the receptacle.

6. The connector of claim 5, wherein the thick portion is formed by the erroneous connection preventing projection and the projection overlapping each other in a longitudinal direction.

7. The connector of claim 4, wherein the projections are arranged asymmetrically on two of the long sides in the longitudinal direction.

* * * * *